US007199722B2

(12) United States Patent
Oakner et al.

(10) Patent No.: US 7,199,722 B2
(45) Date of Patent: Apr. 3, 2007

(54) TWO WIRE ALARM

(76) Inventors: Stuart P. Oakner, 22058 Flower Dr., Boca Raton, FL (US) 33428; Mark T. Brannick, 9151 Pine Springs Dr., Boca Raton, FL (US) 33428; Donna Ellen Oakner Brannick, 9151 Pine Springs Dr., Boca Raton, FL (US) 33428

( * ) Notice: Subject to any disclaimer, the term of this patent is extended or adjusted under 35 U.S.C. 154(b) by 255 days.

(21) Appl. No.: 10/973,510

(22) Filed: Oct. 26, 2004

(65) Prior Publication Data

US 2005/0280548 A1 Dec. 22, 2005

Related U.S. Application Data

(60) Provisional application No. 60/581,338, filed on Jun. 19, 2004.

(51) Int. Cl.
*H01H 50/54* (2006.01)
*G08B 21/00* (2006.01)

(52) U.S. Cl. ..... 340/652; 361/245

(58) Field of Classification Search ..... 340/652; 361/49, 50, 245, 246
See application file for complete search history.

(56) References Cited

U.S. PATENT DOCUMENTS 4,740,861 A * 4/1988 Droho et al. ..... 361/105
5,655,561 A * 8/1997 Wendel et al. ..... 137/79

* cited by examiner

*Primary Examiner*—Daniel Wu
*Assistant Examiner*—Jennifer Mehmood
(74) *Attorney, Agent, or Firm*—Robert M. Downey, PA

(57) ABSTRACT

An alarm device that connects to a circuit using two wires and is actuated when a switch changes the status of the circuit from a normally closed circuit condition to open circuit condition. The alarm device includes a PC board with an electronic buzzer, an electronic signal transmitter and/or a visual indicator, such as a flashing LED, all of which may be enclosed within a case. The circuitry of the alarm device is non-polarized, thereby allowing the two wires to be connected to either terminal connection point in the circuit.

13 Claims, 1 Drawing Sheet

TWO WIRE ALARM

CROSS REFERENCE TO RELATED APPLICATION

This application claims the benefit of U.S. provisional application No. 60/581,338, filed on Jun. 19, 2004.

FIELD OF THE INVENTION

This invention relates to an alarm device for use in an electric circuit having a normally closed switch and, more particularly, to a self-contained electronic, audible and/or visual alarm device which uses only two wires to connect to the circuit.

DISCUSSION OF THE RELATED ART

Alarm devices of various types are used in circuits to indicate an abnormal condition or change in circuit status. Typically, when an alarm device is used in a circuit, the alarm device is wired to a normally open switch in a manner that causes the alarm to actuate when the switch closes.

There are several drawbacks associated with the various alarm devices presently known in the related art. In particular, most alarm devices that connect to an electric circuit require use of an independent control device. Moreover, installation of these various alarm devices requires connection of at least three wires, and in some instances five or more wires, to specific corresponding wires of the same polarity or component in the circuit. Often, these wires are color coded and must be matched with the same corresponding color wires of the system circuit. Unfortunately, the correct connecting wire pairs are not always of the same color. The need for an independent control device and numerous wire connections makes installation of prior art alarm devices complicated and costly. In most instances, installation must be performed by a skilled technician.

OBJECTS AND ADVANTAGES OF THE INVENTION

With the foregoing shortcomings of the prior art in mind, it is a primary object of the present invention to provide an alarm device for connection to an electric circuit for indicating by visual, electronic and/or audible signal that the circuit has changed from a normally closed state to an open circuit condition.

It is a further object of the present invention to provide an alarm device for connection to an electric circuit, and wherein the alarm device requires only two wires for simple connection to the circuit.

It is a further object of the present invention to provide an alarm device, as set forth above, which is small in size and of simple and low cost design, and may be housed within a single case enclosure.

It is still a further object of the present invention to provide a non-polarized alarm device, as set forth above, which uses only two connecting wires that are adapted to be connected to either of the two opposite terminal connections of the circuit.

It is still a further object of the present invention to provide an alarm device, as set forth above, which is simple to install without requiring any technical expertise.

It is still a further object of the present invention to provide an alarm device, as set forth above, which is self-contained, thereby avoiding the need for other components, such as a separate control device.

It is still a further object of the present invention to provide a simple and inexpensive alarm device, as set forth above, which has a non-polarized circuit with two wires that connect either way to the opposite terminal connection points of a switch in the circuit.

These and other objects and advantages of the present invention are more readily apparent with reference to the following detailed description and accompanying drawings.

SUMMARY OF THE INVENTION

The present invention is directed to an alarm device for use in an electric circuit to indicate by visual electronic and/or audible signal that the circuit has changed from a normally closed state to an open circuit condition. In one preferred embodiment, the alarm device includes a PC board that carries an electronic buzzer, an electronic signal generator and/or a visual indicator, such as a flashing LED, all of which may be enclosed within a single case. The alarm device uses two wires to connect to either terminal of the circuit. More specifically, the circuitry of the alarm device is non-polarized so that either one of the connecting wires of the alarm device can be connected to the positive terminal in the circuit with the other wire being connected to the negative terminal. When the circuit opens, as a result of operation of a switch, the alarm is actuated to send an electronic signal, and/or provide an audible and visual indication of the open circuit condition.

In another embodiment, the alarm device may be packaged with a separate water sensitive switch and a circuit. In this embodiment, the PC board may be encased with an AC power transformer or battery compartment so that the device can be used anywhere there is available 120 volt AC power or batteries. In a common installation, the water sensitive switch connected to the circuit would clip onto an HVAC or water heater overflow pan, or be installed in the areas around plumbing fixtures. The separate alarm device, connected to the circuit by wires, wireless signal or other means, could be installed remote from the switch in a location more likely to be observed and/or heard by dwelling occupants. With the AC power transformer or battery compartment, the alarm device can plug into any household electrical outlet or use batteries for a power source. In this embodiment, the alarm device is actuated when the switch opens the circuit in response to a sensed condition. The circuit, when opened in such manner, may be installed so as to disable operation of connected components or equipment in addition to activating the alarm.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 2:
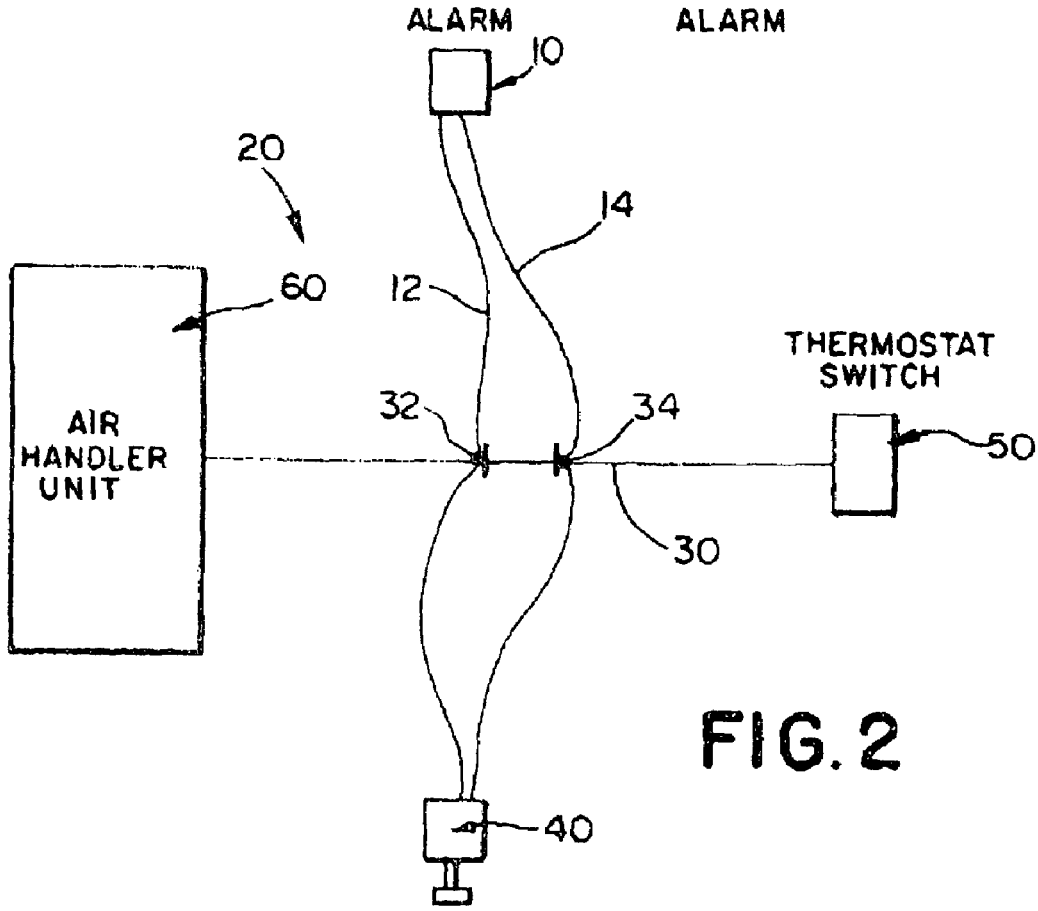
FIG. 2 is a basic wiring diagram illustrating an example installation of the alarm device to the thermostat circuit of an HVAC system in conjunction with a water sensitive float switch.

Referring initially to FIG. 2, the alarm device of the present invention is shown connected to the control circuit of an HVAC system 20, wherein the alarm device is generally indicated as 10.

The alarm device 10 is shown connected to the control circuit of an HVAC system in FIG. 2 for purposes of example. It is recognized that use of the alarm device 10 is not limited to an HVAC system but, rather, the alarm device 10 may be used in any circuit for the purpose of providing an audible and/or visual alert to the change in status of the circuit from a normally closed circuit condition to an open circuit condition. For example, the alarm device can be used in an HVAC system circuit, such as in FIG. 2, for providing an audible and/or visual alert to the existence of a problem, such as a drain occlusion or clog, which is causing a high liquid level condition, overflow or flood. In this instance, the alarm device 10 provides an electronic signal and/or an audible and/or visual alert to the homeowner or building occupant that power to the system (e.g. HVAC system) has been interrupted due to a high level liquid condition resulting from an occlusion or other abnormality in the drainage assembly.

As seen in FIG. 2, the alarm device 10 uses two connecting wires 12, 14 for connecting the alarm device 10 to the circuit 30. In this example, the wires 12, 14 connect in series with float switch 40 along the single conductor connecting between the thermostat switch 50 and the air handler unit 60 of the HVAC system 20. The non-polarized circuitry of the alarm device 10 allows for reverse connection of the wires 12, 14. Thus, the wires 12, 14 of the alarm device are each connected to a different one of the terminal connection points 32, 34 where the float switch connects to the thermostat circuit. However, the connection of wires 12, 14 to points 32, 34 may be reversed while still allowing full function of the alarm device 10. This allows for ease of connection of the wires 12, 14 to the circuit without the possibility of error, as long as both wires 12, 14 are not connected to the same point.

In the event the circuit changes from a closed condition to an open condition (e.g. due to operation of a switch in the circuit), the alarm device is energized to send an electronic signal and/or actuate either or both an audible and visual alarm indicator. In a preferred embodiment, the audible alarm indicator is a piezo electric buzzer 70 and the visual alarm indicator is a flashing LED 80.

Figure 1:
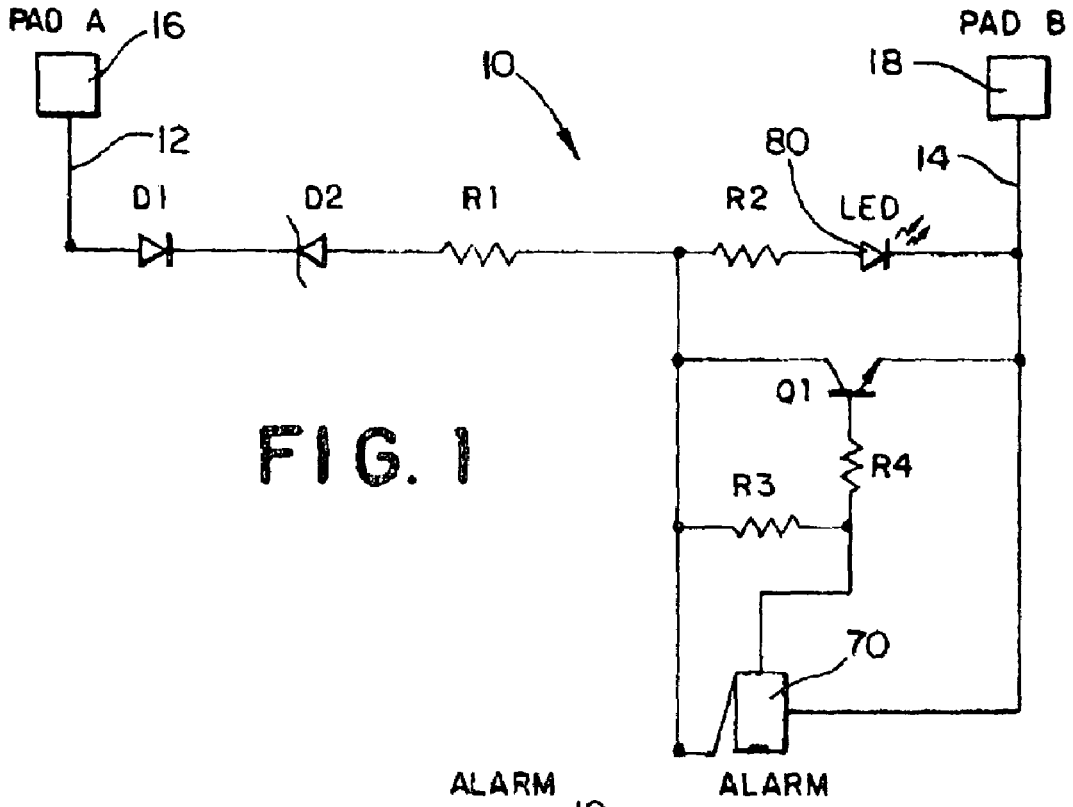
FIG. 1 is a schematic diagram of the two wire alarm device of the present invention that senses an open circuit condition.

Referring to FIG. 1, a schematic diagram of the circuitry of the alarm device 10 is shown. As illustrated, the circuitry of the alarm device 10 includes a piezo electric buzzer 70 and flashing red LED 80. The circuitry of the alarm may also contain an electronic signal transmitter or generator. These components, along with resisters R1–R5 and diodes D1 and D2 are housed on a PC board that may be enclosed within a case. The wires 12, 14 are connected to the circuitry and extend from the PC board. The terminal ends of the wires 12, 14 may be provided with connecter elements 16, 18 for ease of connection to the terminal connection points 32, 34 along the circuit.

While the instant invention has been shown and described in accordance with a preferred and practical embodiment thereof, it is recognized that departures from the instant disclosure are contemplated within the spirit and scope of the present invention.

What is claimed is:

1. An alarm device for an electric circuit having first and second terminal connection points, comprising:

non-polarized circuitry;

first and second wire conductors for connecting said non-polarized circuitry of said device to the first and second terminal connection points of the electric circuit, and said non-polarized circuitry being adapted to permit connection of either of said first and second wire conductors to said first terminal connection point with the other one of said first and second wire conductors connected to the second terminal connection point; and an alarm indicator structured to be actuated in response to opening of the electric circuit for indicating a change in status of the electric circuit from a normally closed circuit condition to an open circuit condition.

2. The alarm device as recited in claim 1 wherein said alarm indicator is an audible alarm.

3. The alarm device as recited in claim 2 wherein said audible alarm is an electric buzzer.

4. The alarm device as recited in claim 1 wherein said alarm indicator is a visual alarm.

5. The alarm device as recited in claim 4 wherein said visual alarm is a light emitting diode.

6. The alarm device as recited in claim 1 wherein said alarm indicator comprises both an audible and a visual alarm indicator.

7. The alarm device as recited in claim 1 further comprising a signal transmitter structured to transmit a signal to said alarm indicator in response to opening of the electric circuit.

8. An alarm device for an electric circuit, comprising:

non-polarized circuitry;

first and second wire conductors for connecting said non-polarized circuitry of said device to first and second terminal connection points of the electric circuit, and said non-polarized circuitry being adapted to permit connection of either of said first and second wire conductors to said first terminal connection point while the other one of said first and second wire conductors is connected to the second terminal connection point;

a signal transmitter structured to transmit a signal in response to opening of the electric circuit; and an alarm indicator including a signal receiver, said alarm indicator being structured to be actuated upon receipt of said signal transmitted by said signal transmitter to thereby indicate a change in status of the electric circuit from a normally closed circuit condition to an open circuit condition.

9. The alarm device as recited in claim 8 wherein said alarm indicator is an audible alarm.

10. The alarm device as recited in claim 9 wherein said audible alarm is an electronic buzzer.

11. The alarm device as recited in claim 8 wherein said alarm indicator is a visual alarm.

12. The alarm device as recited in claim 11 wherein said visual alarm is a light emitting diode.

13. The alarm device as recited in claim 8 wherein said alarm indicator comprises both an audible alarm indicator and a visual alarm indicator.

* * * * *